US010605493B2

(12) United States Patent
Singh et al.

(10) Patent No.: US 10,605,493 B2
(45) Date of Patent: Mar. 31, 2020

(54) REFRIGERATOR APPLIANCE WITH A CLEAR ICEMAKER

(71) Applicant: Haier US Appliance Solutions, Inc., Wilmington, DE (US)

(72) Inventors: Anoop Singh, Bangalore (IN); Ashutosh Kulkarni, Bangalore (IN)

(73) Assignee: Haier US Appliance Solutions, Inc., Wilmington, DE (US)

( * ) Notice: Subject to any disclaimer, the term of this patent is extended or adjusted under 35 U.S.C. 154(b) by 397 days.

(21) Appl. No.: 15/415,971

(22) Filed: Jan. 26, 2017

(65) Prior Publication Data

US 2018/0209711 A1 Jul. 26, 2018

(51) Int. Cl.

| | |
|---|---|
| ***F25C 1/00*** | (2006.01) |
| ***F25B 5/02*** | (2006.01) |
| ***F25C 1/18*** | (2006.01) |
| ***F25B 41/06*** | (2006.01) |
| *F25C 1/12* | (2006.01) |
| *F25D 23/04* | (2006.01) |
| *F25D 17/06* | (2006.01) |

(52) U.S. Cl.

CPC ..... *F25B 5/02* (2013.01); *F25B 41/067* (2013.01); *F25C 1/18* (2013.01); *F25B 2341/062* (2013.01); *F25B 2341/0662* (2013.01); *F25C 1/12* (2013.01); *F25C 2500/02* (2013.01); *F25D 17/065* (2013.01); *F25D 23/04* (2013.01); *F25D 2317/061* (2013.01)

(58) Field of Classification Search

CPC ..... F25C 1/12; F25C 2400/10; F25C 1/04; F25C 5/22; F25D 11/022; F25B 5/02; F25B 2341/066; F25B 2341/0661; F25B 2341/0662

See application file for complete search history.

(56) References Cited

U.S. PATENT DOCUMENTS

| | | | |
|---|---|---|---|
| 3,995,636 | A | 12/1976 | Murray et al. |
| 4,497,707 | A | 2/1985 | Anderson |
| 4,521,309 | A | 6/1985 | Pall |

(Continued)

FOREIGN PATENT DOCUMENTS

| | | | |
|---|---|---|---|
| CN | 2514297 | Y | 10/2002 |
| EP | 1936305 | A2 | 6/2008 |

(Continued)

OTHER PUBLICATIONS

PCT Search Report and Written Opinion PCT/US2014/056282, dated Nov. 27, 2014. (11 pages).

(Continued)

*Primary Examiner* — Eric S Ruppert

(74) *Attorney, Agent, or Firm* — Dority & Manning, P.A.

(57) ABSTRACT

A refrigerator appliance includes a sealed system with a first evaporator connected in series with a first capillary tube and a second evaporator connected in series with second and third capillary tubes such that the second evaporator is between the second and third capillary tubes. The first capillary tube is sized such that the chilled air at the first evaporator is a first temperature during operation of the sealed system. The second capillary tube is sized such that the chilled air at the second evaporator is a second, different temperature during operation of the sealed system.

14 Claims, 6 Drawing Sheets

(56) References Cited

U.S. PATENT DOCUMENTS 4,619,677 A 10/1986 Matheson et al.
4,855,077 A 8/1989 Shikinami et al.
4,912,942 A 4/1990 Katterhenry et al.
5,089,144 A 2/1992 Ozkahyaoglu et al.
5,135,645 A 8/1992 Sklenak et al.
5,171,430 A 12/1992 Beach et al.
5,190,666 A 3/1993 Bisconte
5,192,424 A 3/1993 Beyne et al.
5,328,597 A 7/1994 Boldt, Jr. et al.
5,536,264 A 7/1996 Hsueh et al.
5,907,958 A 6/1999 Coates et al.
6,009,404 A 12/1999 Eimer
6,051,144 A 4/2000 Clack et al.
6,139,738 A 10/2000 Maxwell
6,148,621 A * 11/2000 Byczynski ..... F25C 1/12 62/135
6,153,105 A 11/2000 Tadlock et al.
6,205,807 B1 3/2001 Broadbent
6,303,031 B1 10/2001 Senner
6,337,015 B1 1/2002 Poirier
6,355,177 B2 3/2002 Senner et al.
6,533,926 B2 3/2003 Hawkins et al.
6,537,444 B2 3/2003 Wilberscheid et al.
6,551,503 B2 4/2003 Niers et al.
6,708,518 B1 3/2004 Jones et al.
6,753,783 B2 6/2004 Friedman et al.
6,865,941 B2 3/2005 Gibbs
6,950,032 B1 9/2005 Hewitt et al.
7,062,936 B2 6/2006 Rand et al.
7,067,054 B2 6/2006 Fritze
RE39,361 E 10/2006 Den Dekker
7,481,917 B2 1/2009 Ikeyama et al.
7,638,042 B2 12/2009 Astle et al.
7,736,495 B2 6/2010 Ikeyama et al.
7,836,708 B2 11/2010 Krause et al.
7,874,457 B2 1/2011 Sowers et al.
8,025,186 B2 9/2011 Lee et al.
8,057,669 B2 11/2011 Beard et al.
8,118,997 B2 2/2012 Ebrom et al.
8,196,809 B2 6/2012 Thorstensson
8,216,463 B1 7/2012 Baird
8,240,159 B2 8/2012 Prabhakar et al.
8,242,893 B1 8/2012 Lin
8,282,820 B2 10/2012 Cur et al.
8,289,173 B2 10/2012 Ben-Mansour et al.
8,459,047 B2 6/2013 Hall et al.
8,544,291 B2 10/2013 Kim et al.
8,695,371 B2 4/2014 Boarman et al.
8,746,003 B2 6/2014 Yoon
8,844,314 B2 9/2014 Bortoletto et al.
8,950,197 B2 2/2015 Bortoletto et al.
9,046,299 B2 6/2015 An et al.
9,074,802 B2 7/2015 Culley et al.
9,074,803 B2 7/2015 Culley
9,080,800 B2 7/2015 Culley
9,151,527 B2 10/2015 Boarman et al.
9,273,890 B2 3/2016 Bortoletto et al.
9,303,903 B2 4/2016 Boarman et al.
9,506,682 B2 11/2016 Yun et al.
10,072,888 B2 9/2018 Jeong et al.
2002/0189983 A1 12/2002 Guess et al.
2004/0001991 A1 1/2004 Kinkelaar et al.
2004/0007516 A1 1/2004 Fritze et al.
2004/0025527 A1 2/2004 Takahashi et al.
2004/0251210 A1 12/2004 Fritze et al.
2005/0092070 A1 5/2005 Bhatti
2005/0167352 A1 8/2005 Burrows et al.
2005/0194317 A1 9/2005 Ikeyama et al.
2005/0263457 A1 12/2005 Wilkins et al.
2006/0011523 A1 1/2006 Schrott et al.
2006/0060512 A1 3/2006 Astle et al.
2006/0186031 A1 8/2006 Fick et al.
2008/0034761 A1 2/2008 Hartley
2008/0055112 A1 3/2008 McGinty et al.
2009/0046715 A1 2/2009 McCoy
2009/0134074 A1 5/2009 Doran
2009/0293508 A1 12/2009 Rafalovich et al.
2010/0100026 A1 4/2010 Morris
2010/0218540 A1 9/2010 McCollough et al.
2010/0275633 A1 11/2010 An et al.
2011/0036109 A1 2/2011 Krause et al.
2011/0036782 A1 2/2011 DiLeo
2011/0062060 A1 3/2011 Royal et al.
2011/0126576 A1 6/2011 Jeong
2011/0209483 A1* 9/2011 Hall ..... F25C 1/08 62/66
2012/0118001 A1 5/2012 Mitchell et al.
2012/0130330 A1 5/2012 Wilson et al.
2012/0297817 A1 11/2012 Krause et al.
2012/0324913 A1 12/2012 Bortoletto et al.
2012/0324914 A1 12/2012 Bortoletto et al.
2013/0008838 A1 1/2013 Burke et al.
2013/0068673 A1 3/2013 Maggiore et al.
2013/0240431 A1 9/2013 Foix et al.
2014/0018727 A1 1/2014 Burbank et al.
2014/0110331 A1 4/2014 Baird
2014/0158638 A1 6/2014 Caulkins et al.
2014/0200538 A1 7/2014 Euliano et al.
2014/0305930 A1 10/2014 Heizer et al.
2014/0353235 A1 12/2014 Sherman et al.
2015/0101669 A1 4/2015 Kraus et al.
2015/0102931 A1 4/2015 Chernov et al.
2015/0135758 A1* 5/2015 Miller ..... F25C 1/12 62/340
2015/0192338 A1 7/2015 Knatt
2015/0290567 A1 10/2015 Chernov et al.
2015/0290568 A1 10/2015 Chernov et al.
2015/0290569 A1 10/2015 Chernov et al.
2016/0025406 A1 1/2016 An

FOREIGN PATENT DOCUMENTS

JP 03191748 A * 8/1991
JP 2001016025 A 1/2001
JP 2003192096 A 7/2003
JP 3665260 B2 6/2005
JP 2006258684 A 9/2006
JP 2007147356 A 6/2007
JP 2007163255 A 6/2007
KR 20120120844 A 11/2012
WO WO 83/02523 A1 7/1983
WO WO 97/38272 A1 10/1997
WO WO 03/011426 A1 2/2003
WO WO 03/084875 A1 10/2003
WO WO 2004/037383 A1 5/2004
WO WO 2007068506 A1 6/2007
WO WO 2008061179 A2 5/2008
WO WO 2008/125530 A1 10/2008

OTHER PUBLICATIONS

PCT Search Report and Written Opinion PCT/US2014/060223, dated Jan. 23, 2015. (9 pages).

* cited by examiner

REFRIGERATOR APPLIANCE WITH A CLEAR ICEMAKER

FIELD OF THE INVENTION

The present subject matter relates generally to refrigerator appliances and clear icemakers for refrigerator appliances.

BACKGROUND OF THE INVENTION

Certain refrigerator appliances include an icemaker. To produce ice, liquid water is directed to the icemaker and frozen. A variety of ice types can be produced depending upon the particular icemaker used. For example, certain icemakers include a mold body for receiving liquid water. Within the mold body, liquid water is stationary and freezes to form ice cubes. Such icemakers can also include a heater and/or an auger for harvesting ice cubes from the mold body.

Freezing stationary water within a mold body to form ice cubes has certain drawbacks. For example, ice cubes produced in such a manner can be cloudy or opaque, and certain consumers prefer clear ice cubes. In addition, harvesting ice cubes from the mold body with the heater and auger can be energy intensive such that an efficiency of an associated refrigerator appliance is decreased. Ice formation within the mold body can also be relatively slow such that maintaining a sufficient supply of ice cubes during periods of high demand is difficult. Further, icemakers with such mold bodies can occupy large volumes of valuable space within refrigerator appliances.

Accordingly, an ice making assembly for a refrigerator appliance with features for generating relatively clear ice cubes would be useful. In addition, an ice making assembly for a refrigerator appliance with features for generating ice cubes quickly and/or efficiently would be useful. Also, an ice making assembly for a refrigerator appliance that occupies a relatively small volume within the refrigerator appliance would be useful.

BRIEF DESCRIPTION OF THE INVENTION

The present subject matter provides a refrigerator appliance with a sealed system. The sealed system includes a first evaporator connected in series with a first capillary tube and a second evaporator connected in series with second and third capillary tubes such that the second evaporator is between the second and third capillary tubes. The first capillary tube is sized such that the chilled air at the first evaporator is a first temperature during operation of the sealed system. The second capillary tube is sized such that the chilled air at the second evaporator is a second, different temperature during operation of the sealed system. Additional aspects and advantages of the invention will be set forth in part in the following description, or may be apparent from the description, or may be learned through practice of the invention.

In a first exemplary embodiment, a refrigerator appliance is provided. The refrigerator appliance includes a cabinet that defines a chilled chamber for receipt of food items for storage. The cabinet has a door and defines a duct. An icemaker includes a mold body that defines an ice cavity and also includes a manifold positioned over the ice cavity of the mold body such that water from the manifold is flowable through the ice cavity. A sealed system is positioned within the cabinet. The sealed system includes a compressor operable to generate compressed refrigerant. A first capillary tube is connected to receive the compressed refrigerant. A first evaporator is positioned proximate the chilled chamber of the cabinet. The first evaporator is connected in series with the first capillary tube. A second capillary tube is connected to receive the compressed refrigerant. The sealed system also includes a third capillary tube. A second evaporator is positioned proximate an inlet of the duct. The second and third capillary tubes are connected in series with the second evaporator such that the second evaporator is between the second and third capillary tubes. The first capillary tube is sized such that the chilled air at the first evaporator is a first temperature during operation of the sealed system. The second capillary tube is sized such that the chilled air at the second evaporator is a second temperature during operation of the sealed system. The first temperature is less than the second temperature.

In a second exemplary embodiment, a refrigerator appliance is provided. The refrigerator appliance includes a cabinet that defines a chilled chamber for receipt of food items for storage. The cabinet has a door and defines a duct. An icemaker is positioned on the door of the cabinet. The icemaker includes a mold body that defines an ice cavity and also includes a manifold positioned over the ice cavity of the mold body such that water from the manifold is flowable through the ice cavity. A sealed system is positioned within the cabinet. The sealed system includes a compressor that is operable to generate compressed refrigerant. A first capillary tube has an inlet that is connected to an outlet of the compressor to receive the compressed refrigerant from the compressor. A first evaporator is positioned proximate the chilled chamber of the cabinet. The first evaporator is connected in series with the first capillary tube. A second capillary tube has an inlet that is connected to the outlet of the compressor to receive the compressed refrigerant from the compressor. A third capillary tube has an outlet that is connected to an inlet of the compressor. A second evaporator is positioned proximate an inlet of the duct. The second and third capillary tubes are connected in series with the second evaporator such that the second evaporator is between the second and third capillary tubes. The first capillary tube is sized such that chilled air at the first evaporator is a first temperature during operation of the sealed system. The second capillary tube is sized such that chilled air at the second evaporator is a second temperature during operation of the sealed system. The first temperature is less than the second temperature.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
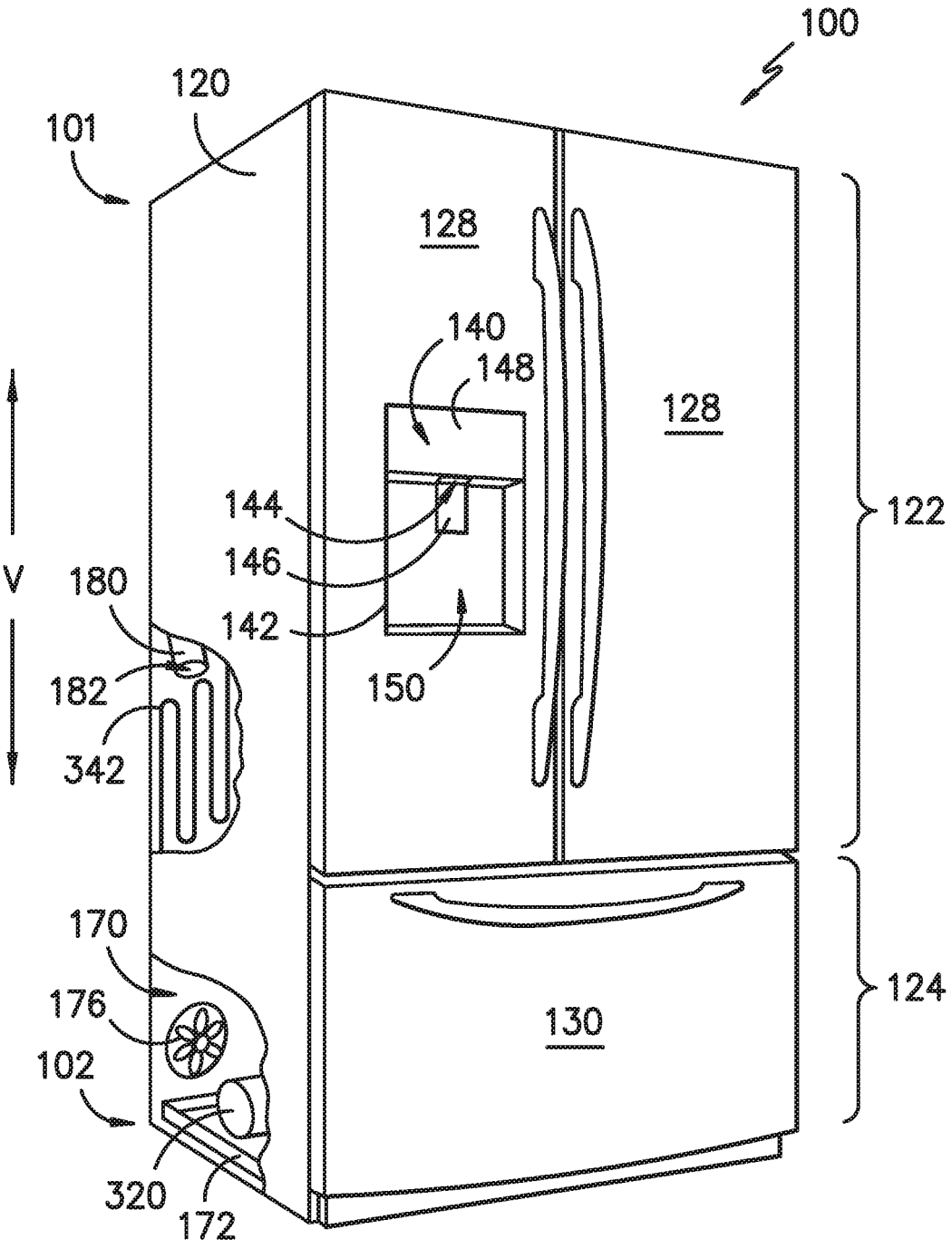
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that extends between a top portion 101 and a bottom portion 102 along a vertical direction V. Housing 120 defines chilled chambers for receipt of food items for storage. In particular, housing 120 defines a fresh food chamber 122 positioned at or adjacent top portion 101 of housing 120 and a freezer chamber 124 arranged at or adjacent bottom portion 102 of housing 120. As such, refrigerator appliance 100 is generally referred to as a "bottom mount refrigerator." It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular chilled chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in a closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 128. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 128. In the exemplary embodiment, dispenser recess 150 is positioned at a level that approximates the chest level of a user.

Figure 2:
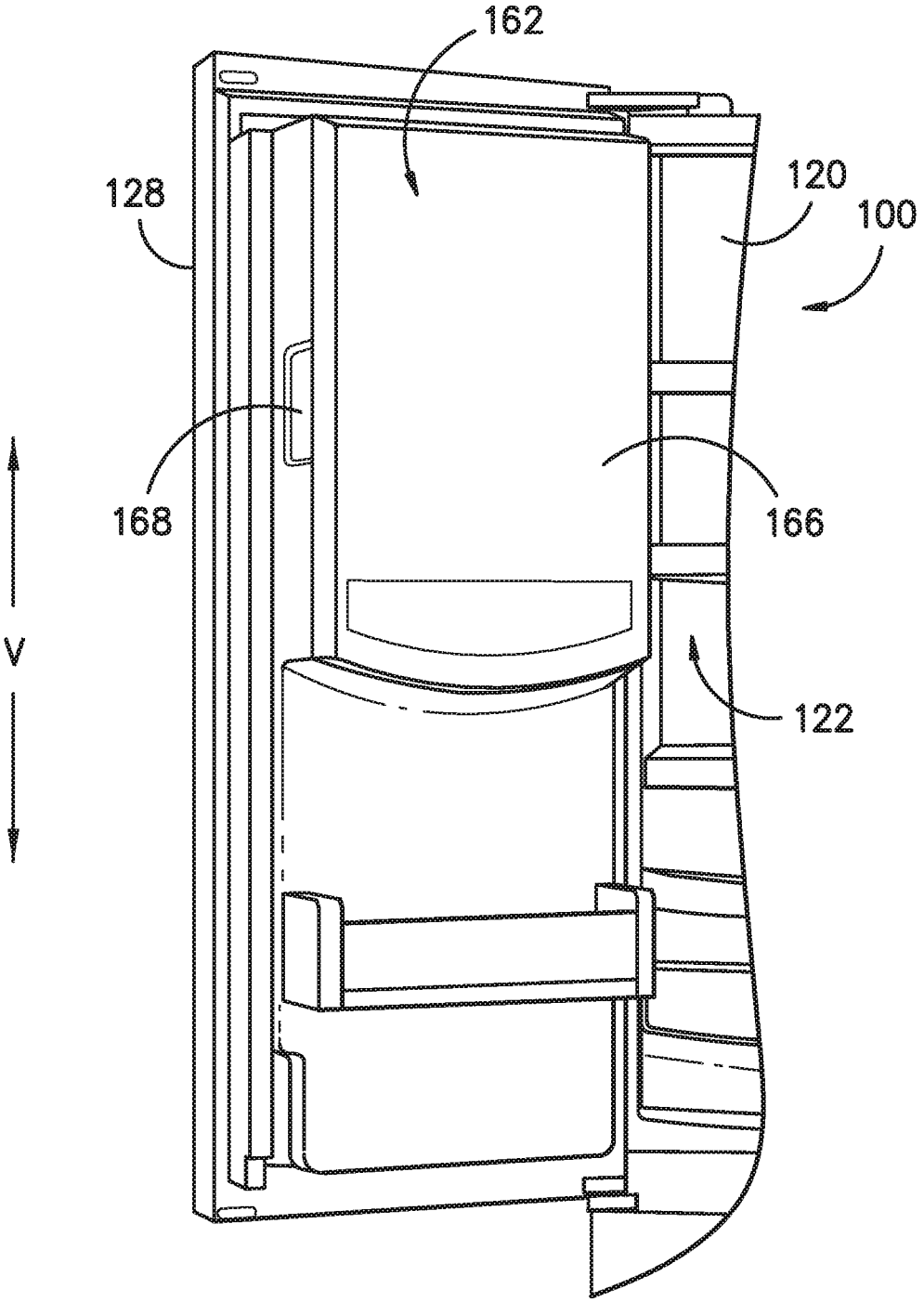
FIG. 2 provides a perspective view of a door of the exemplary refrigerator appliance of FIG. 1.
Figure 3:
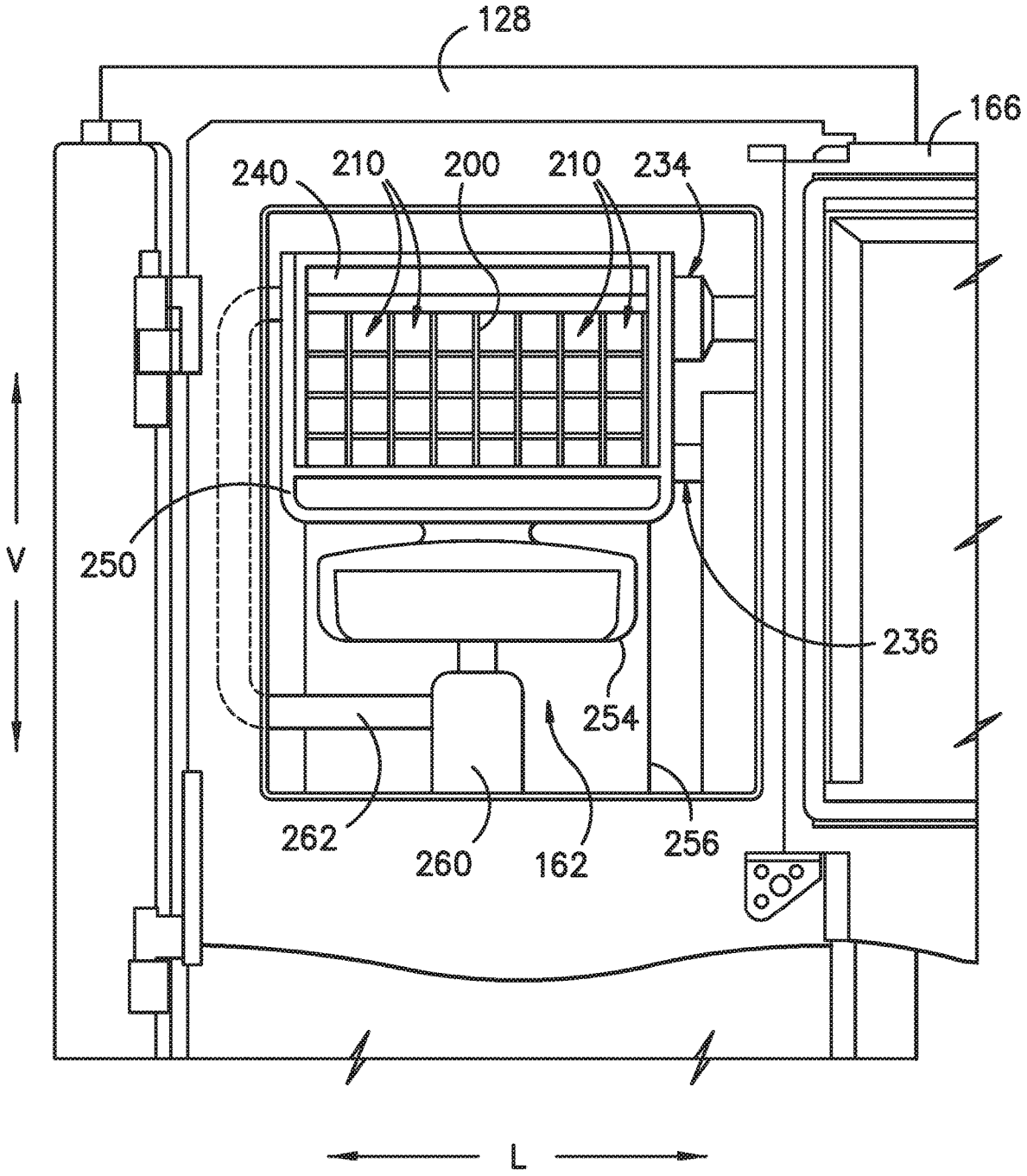
FIG. 3 provides a partial, elevation view of the door of the exemplary refrigerator appliance of FIG. 2 with an access door of the door shown in an open position.

FIG. 2 provides a perspective view of a door of refrigerator doors 128. FIG. 3 provides a partial, elevation view of refrigerator door 128 with an access door 166 shown in an open position. Refrigerator appliance 100 includes a sub-compartment 162 defined on refrigerator door 128. Sub-compartment 162 is often referred to as an "icebox." Sub-compartment 162 is positioned on refrigerator door 128 at or adjacent fresh food chamber 122. Thus, sub-compartment 162 may extend into fresh food chamber 122 when refrigerator door 128 is in the closed position.

As may be seen in FIG. 3, refrigerator appliance 100 includes an icemaker or ice making assembly 160. It will be understood that while described in the context of refrigerator appliance 100, ice making assembly 160 can be used in any suitable refrigerator appliance. Thus, e.g., in alternative exemplary embodiments, ice making assembly 160 may be positioned at and mounted to other portions of housing 120, such as within freezer chamber 124 or sub-compartment 162 may be fixed to a wall of housing 120 within fresh food chamber 122 rather than on refrigerator door 128.

In FIG. 3, ice making assembly 160 and an ice storage bin or collector 256 are positioned or disposed within sub-compartment 162. Thus, ice is supplied to dispenser recess 150 (FIG. 1) from the ice making assembly 160 and/or ice-collector 256 in sub-compartment 162 on a back side of refrigerator door 128. Chilled air from a sealed system 300 (FIG. 7) of refrigerator appliance 100 may be directing into ice making assembly 160 in order to cool components of ice making assembly 160. In particular, a first evaporator 332 (FIG. 7), e.g., positioned at or within fresh food chamber 122 or freezer chamber 124, is configured for generating cooled or chilled air for the fresh food chamber 122 and/or freezer chamber 124. A second evaporator 342 is also configured for generating cooled or chilled air. A supply conduit 180, e.g., defined by or positioned within housing 120, extends between second evaporator 342 and components of ice making assembly 160 in order to cool components of ice making assembly 160 and assist ice formation by ice making assembly 160. Sealed system 300 is discussed in greater detail below in the context of FIG. 7.

During operation of ice making assembly 160, chilled air from the sealed system 300 cools components of ice making assembly 160 to or below a freezing temperature of liquid water. Thus, ice making assembly 160 is an air cooled ice making assembly. Chilled air from the sealed system may also cool ice-collector 256. In particular, air around ice-collector 256 can be chilled to a temperature above the freezing temperature of liquid water, e.g., to about the temperature of fresh food chamber 122, such that ice cubes in ice-collector 256 melt over time due to being exposed to air having a temperature above the freezing temperature of liquid water. In addition, ice making assembly 160 may be also be exposed to air having a temperature above the freezing temperature of liquid water. As an example, air from fresh food chamber 122 can be directed into sub-compartment 162 such that ice making assembly 160 and/or ice-collector 256 is exposed to air from fresh food chamber 122.

Liquid water generated during melting of ice cubes in ice-collector 256, is directed out of ice-collector 256. In particular, turning back to FIG. 1, liquid water from melted ice cubes is directed to an evaporation pan 172, e.g., via a suitable line, hose or conduit. Evaporation pan 172 is positioned within a mechanical compartment 170 defined by housing 120, e.g., at bottom portion 102 of housing 120. A condenser 320 of sealed system 300 can be positioned, e.g., directly, above and adjacent evaporation pan 172. Heat from condenser 320 can assist with evaporation of liquid water in evaporation pan 172. A fan 176 configured for cooling condenser 320 can also direct a flow air across or into evaporation pan 172. Thus, fan 176 can be positioned above and adjacent evaporation pan 172. Evaporation pan 172 is sized and shaped for facilitating evaporation of liquid water therein. For example, evaporation pan 172 may be open topped and extend across about a width and/or a depth of housing 120. In alternative exemplary embodiments, excess liquid water from melted ice cubes in ice-collector 256 and/or from ice making assembly 160 can be directed to a drain, e.g., that leads to a sewer or septic waste water system.

Access door 166 is hinged to refrigerator door 128. Access door 166 permits selective access to sub-compartment 162. Any manner of suitable latch 168 is configured with sub-compartment 162 to maintain access door 166 in a closed position. As an example, latch 168 may be actuated by a consumer in order to open access door 166 for providing access into sub-compartment 162. Access door 166 can also assist with insulating sub-compartment 162.

Figure 4:
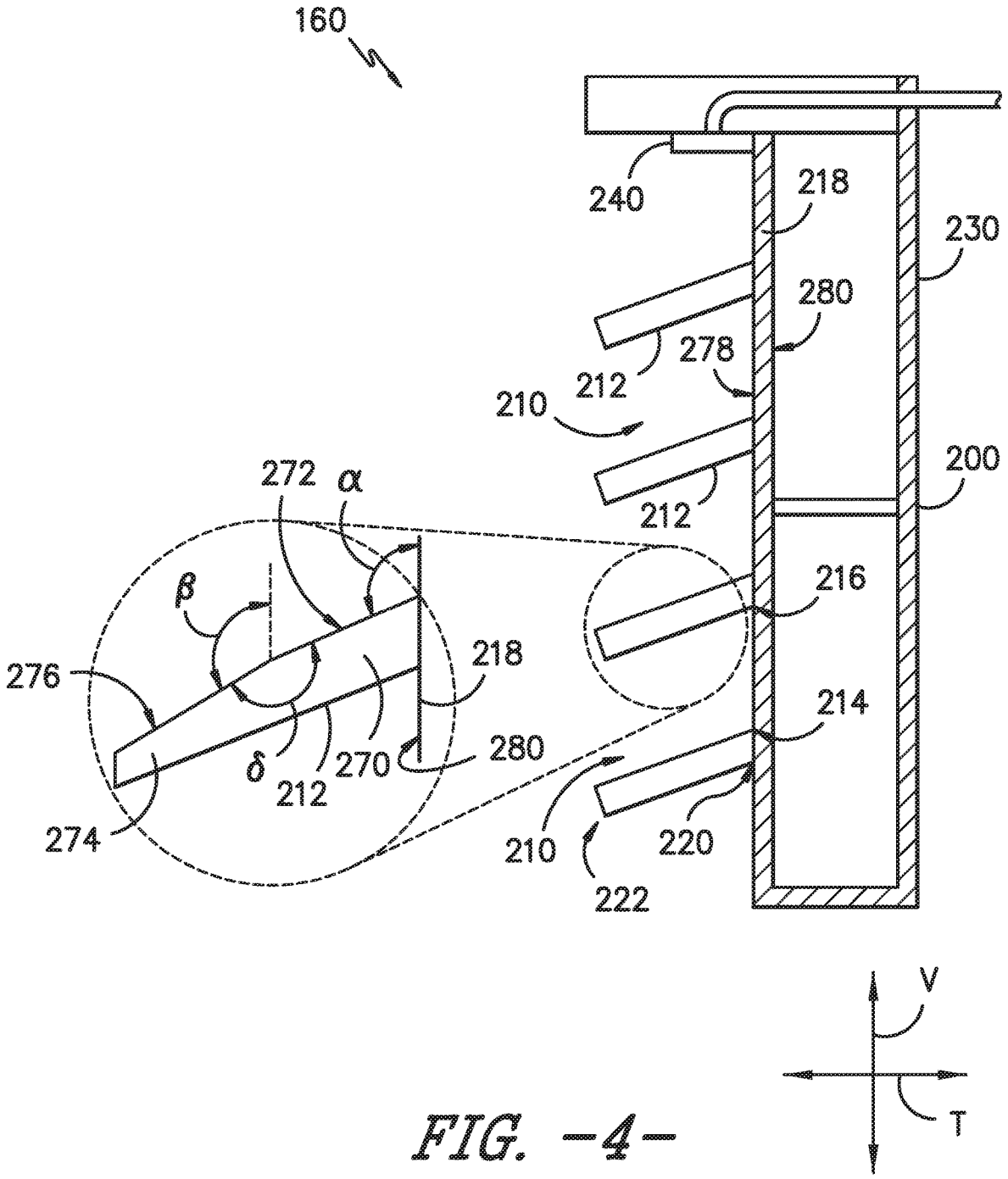
FIG. 4 provides a section view of an icemaker of the exemplary refrigerator appliance of FIG. 2.
Figure 5:
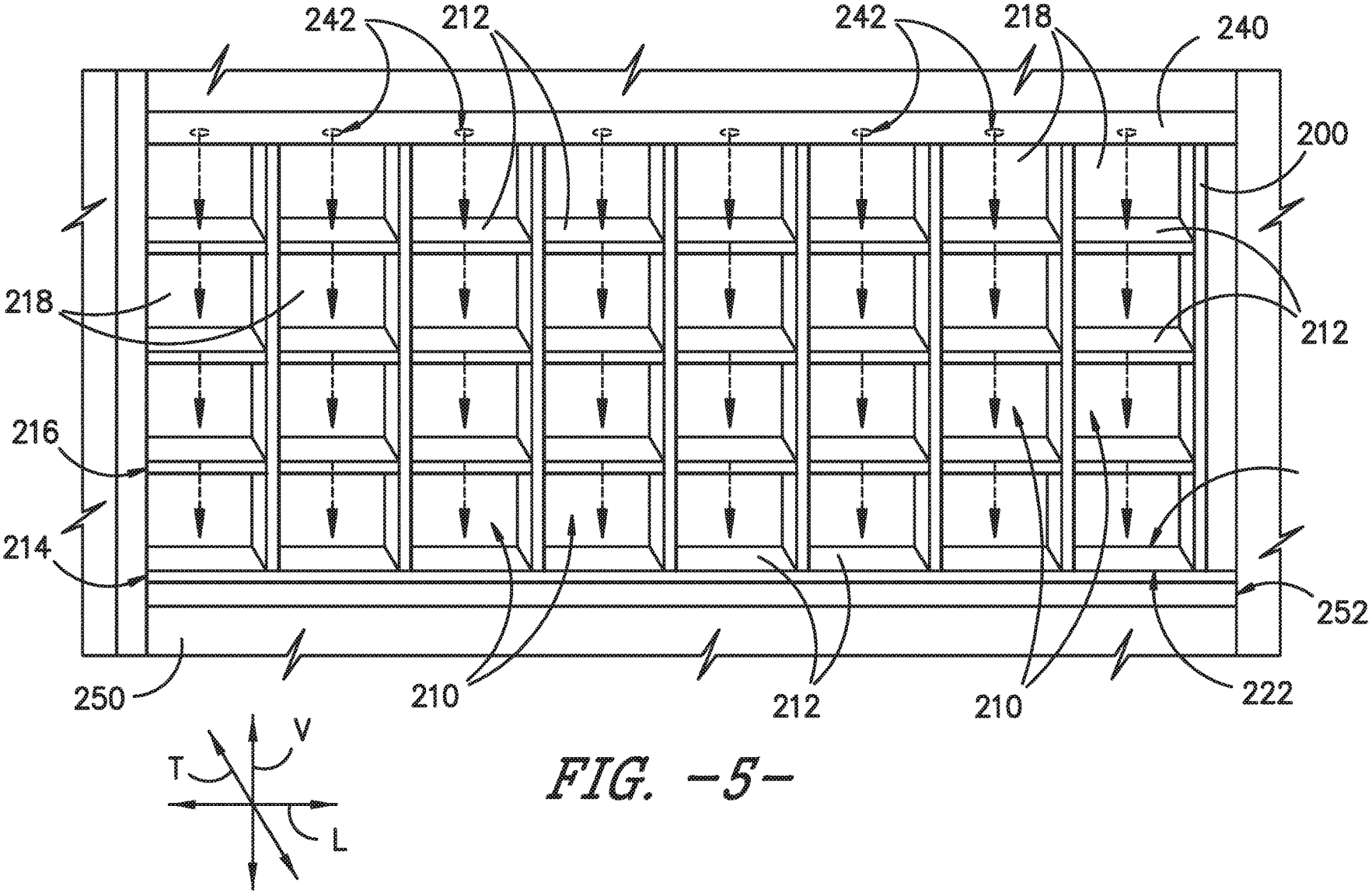
FIG. 5 provides an elevation view of a manifold and a mold body of the icemaker of FIG. 4.

As may be seen in FIGS. 3, 4 and 5, ice making assembly 160 includes a mold body 200 that defines a plurality of ice cavities 210. In particular, each cavity of ice cavities 210 may be defined at least in part by a respective bottom wall 212 and back wall 218 of mold body 200. Each cavity of ice cavities 210 may extend between a bottom portion 214 and a top portion 216 along the vertical direction V, and each cavity of ice cavities 210 may also extend between a rear portion 220 and a front portion 222 along a transverse direction T that is perpendicular to the vertical direction V. Back wall 218 is positioned at or proximate rear portion 220 of ice cavities 210, and bottom wall 212 is positioned at or proximate bottom portion 214 of ice cavities 210.

As shown in the zoomed in portion of FIG. 4, bottom wall 212 has a first bottom wall portion or segment 270 and a second bottom wall portion or segment 274. First bottom wall segment 270 is positioned at or proximate back wall 218. For example, first bottom wall segment 270 may be mounted to and extend away from back wall 218, e.g., along the transverse direction T. First bottom wall segment 270 may be positioned between back wall 218 and second bottom wall segment 274, e.g., along the transverse direction T. For example, second bottom wall segment 274 may be mounted to and extend from first bottom wall segment 270, e.g., along the transverse direction T. It will be understood that bottom wall 212 may have additional segments in alternative exemplary embodiments, e.g., at least one additional bottom wall segment. Thus, the present subject matter is not limited to bottom walls with only two bottom wall segments.

First bottom wall segment 270 has an upper surface 272, and second bottom wall segment 274 also has an upper surface 276. Upper surface 272 of first bottom wall segment 270 and upper surface 276 of second bottom wall segment 274 may be flat or planar, as shown in FIG. 4. First and second bottom wall segments 270, 274 may be positioned and oriented such that upper surface 272 of first bottom wall segment 270 defines a first angle $\alpha$ with a front surface 278 of back wall 218 and such that upper surface 276 of second bottom wall segment 274 defines a second angle $\beta$ with front surface 278 of back wall 218. In alternative exemplary embodiments, upper surface 272 of first bottom wall segment 270 and upper surface 276 of second bottom wall segment 274 may be curved, bent or non-flat. Thus, the first angle $\alpha$ may be defined with a tangent line (e.g., at a center of upper surface 272) of the upper surface 272 of first bottom wall segment 270, and the second angle $\beta$ may be defined with a tangent line (e.g., at a center of upper surface 276) of the upper surface 276 of second bottom wall segment 274.

The first angle $\alpha$ and the second angle $\beta$ may be selected to facilitate formation and harvesting of ice cubes from ice cavities 210. For example, the first angle $\alpha$ may be less than the second angle $\beta$. Thus, water may flow more slowly across first bottom wall segment 270 at back wall 218 while water flows and/or ice cubes slide more quickly across second bottom wall segment 274. Such angling of first bottom wall segment 270 relative to second bottom wall segment 274 may facilitate rapid formation of ice cubes within ice cavities 210 while also facilitating rapid harvesting of ice cubes from ice cavities 210. In certain exemplary embodiments, the first angle $\alpha$ may be no greater than one hundred and thirty degrees) (130°) and no less than eighty degrees (80°), and the second angle $\beta$ may be no greater than one hundred and fifty-five degrees (155°) and no less than ninety-five) (95°) degrees. As may be seen in FIG. 3, mold body 200 defines a lateral direction L that is perpendicular to the transverse direction T. Turning back to FIG. 4, first bottom wall segment 270 may be angled relative to second bottom wall segment 274 such that upper surface 272 of first bottom wall segment 270 and upper surface 276 of second bottom wall segment 274 define an offset angle $\delta$, e.g., in a plane that is perpendicular to the lateral direction L. The offset angle $\delta$ may be about one hundred and sixty-five degrees (165°) and will change based on the first angle $\alpha$ and second angle $\beta$. As used herein, the term "about" means within ten degrees of the stated angle when used in the context of angles.

As may be seen in FIG. 4, back wall 218 has a front surface 278 and a rear surface 280. Front and rear surfaces 278 and 280 are positioned opposite each other on back wall 218. For example, front surface 278 of back wall 218 may face and be exposed to one of ice cavities 210. In contrast, rear surface 280 of back wall 218 may face and be exposed to a chilled air duct 230. Back wall 218 can be constructed of or with any suitable material. For example, back wall 218 may be constructed of or with stainless steel.

Figure 7:
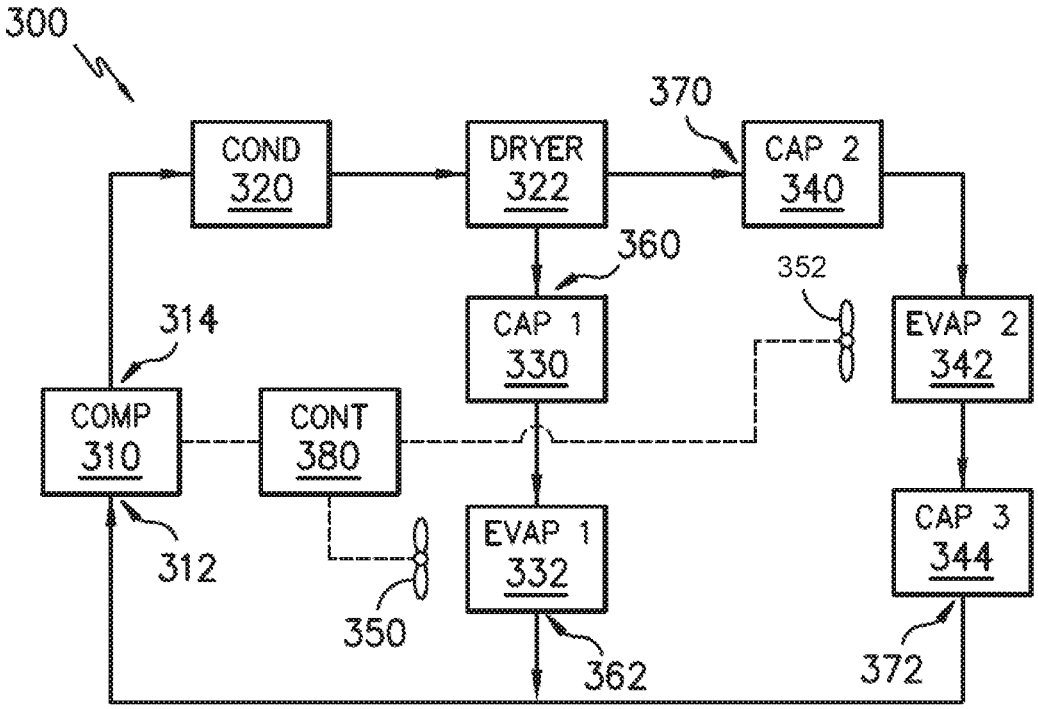
FIG. 7 provides a schematic view of certain components of a sealed system of the exemplary refrigerator appliance of FIG. 2.

Chilled air duct 230 is positioned at or adjacent rear surface 280 of back wall 218. Thus, chilled air duct 230 is positioned opposite ice cavities 210 about back wall 218. As shown in FIG. 3, chilled air duct 230 has an entrance 234 and an exit 236. Chilled air duct 230 is configured or arranged for receiving a flow of chilled air, e.g., from supply conduit 180 and second evaporator 342 (FIG. 7). Thus, chilled air duct 230 may be contiguous with supply conduit 180. In particular, the flow of chilled air enters chilled air duct 230 at entrance 234 of chilled air duct 230 and exits chilled air duct 230 at exit 236 of chilled air duct 230. Chilled air within chilled air duct 230 cools back wall 218, e.g., to permit or facilitate ice cube formation in ice cavities 210, as discussed in greater detail below. Chilled air duct 230 can be constructed of or with any suitable material. For example, chilled air duct 230 may be constructed of or with molded plastic.

A water distribution manifold 240 is positioned above ice cavities 210. Water distribution manifold 240 has or defines a plurality of outlets 242. Each outlet of outlets 242 is aligned with a respective column of ice cavities 210. In particular, each outlet of outlets 242 may be positioned, e.g., directly, above the respective column of ice cavities 210. Liquid water within water distribution manifold 240 can flow out of outlets 242 into ice cavities 210. Due to chilled air within chilled air duct 230, back wall 218 is chilled to or below the freezing temperature of water such that liquid water flowing within ice cavities 210 can freeze on back wall 218 and form ice cubes in ice cavities 210 on mold body 200, e.g., layer-by-layer. Ice cubes in ice cavities 210 can have any suitable shape. For example, ice cubes in ice cavities 210 may be cubic, crescent shaped, etc.

Ice making assembly 160 can be exposed to or operate within air having a temperature greater than a freezing temperature of liquid water. Thus, liquid water within water distribution manifold 240 can be hindered from freezing during operation of ice making assembly 160. However, as discussed above, chilled air within chilled air duct 230 can permit formation of ice cubes in ice cavities 210 on mold body 200, e.g., despite ice making assembly 160 being exposed to or operating within air having a temperature greater than a freezing temperature of liquid water.

Figure 6:
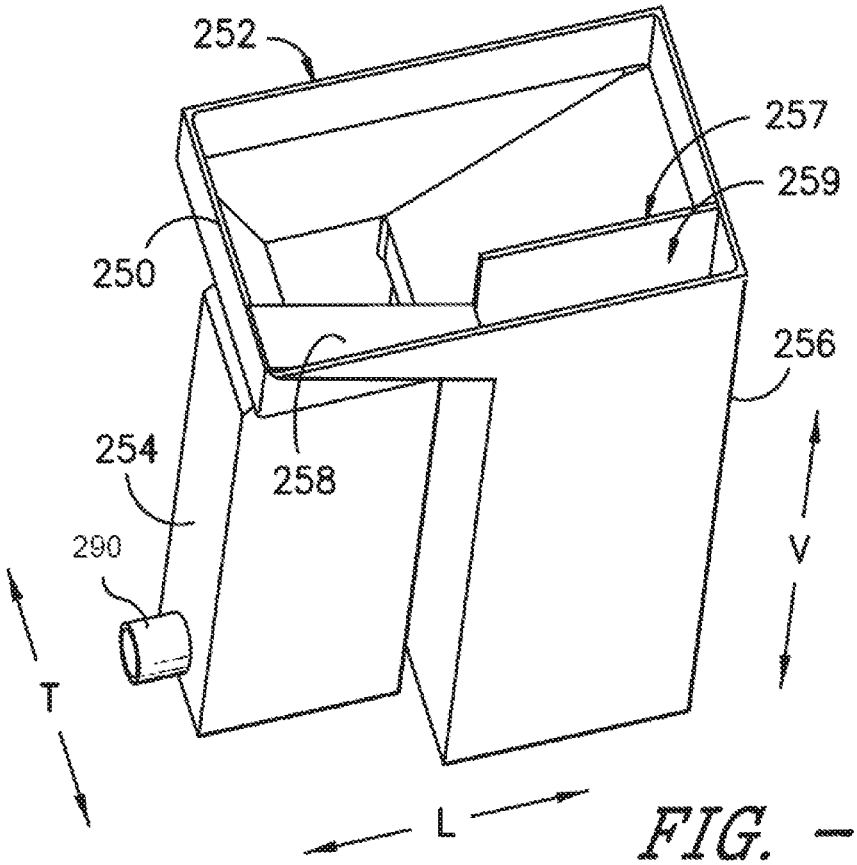
FIG. 6 provides a perspective view of a water funnel and ice-collector of the icemaker of FIG. 4.

A water funnel 250 is positioned at below ice cavities 210. In particular, an inlet 252 of water funnel 250 may be positioned, e.g., directly, below ice cavities 210. Thus, water funnel 250 can receive liquid water runoff from ice cavities 210 during operation of ice making assembly 160 and direct the liquid water runoff to a sump 254 of the water funnel 250. Sump 254 of the water funnel 250 may be spaced apart from ice cavities 210, e.g., along the vertical direction V, to avoid or limit freezing of water within sump 254 of the water funnel 250 during operation of ice making assembly 160. An ice-collector 256 is positioned below second bottom wall segment 274. Thus, ice cubes may slide off second bottom wall segment 274 to an inlet 257 of ice-collector 256, the ice cubes may then slide along a sloped wall 258 of ice-collector 256 to a collection volume 259 of ice-collector 256. As shown in FIG. 6, inlet 252 of water funnel 250 may be offset or unaligned with inlet 257 of ice-collector 256, e.g., in a plane that is perpendicular to the vertical direction V. Water funnel 250 and ice-collector 256 are configured to cooperatively segregate liquid water runoff and harvested ice cubes to separate collection locations. As discussed in greater detail below, the liquid water runoff may be recirculated through mold body 200 while the harvested ice cubes are available for consumption. Water funnel 250 and ice-collector 256 may be formed from a common piece of material, such as molded plastic. Thus, water funnel 250 and ice-collector 256 may have a seamless, one-piece construction as shown in FIG. 6.

By forming ice cubes in ice cavities 210 on mold body 200 with circulating water, ice cubes produced with ice making assembly 160 can be relatively clear or unclouded, e.g., due to collection of impurities or particles within sump 254 of water funnel 250. In addition, ice making assembly 160 can generate ice cubes quickly and/or efficiently, e.g., while occupying a relatively small volume within refrigerator appliance 100.

Turning back to FIG. 3, ice making assembly 160 can also include a circulation pump 260 and a circulation conduit 262. Circulation conduit 262 extends between sump 254 of water funnel 250 and water distribution manifold 240. Circulation pump 260 is coupled to circulation conduit 262 and is operable to pump liquid water from sump 254 to water distribution manifold 240 through circulation conduit 262. Thus, circulation conduit 262 can place sump 254 of water funnel 250 and water distribution manifold 240 in fluid communication with each other and permit liquid water to be recirculated within ice making assembly 160.

Ice making assembly 160 can further include a drain conduit 290. Drain conduit 290 extends between sump 254 of water funnel 250 and evaporation pan 172 (FIG. 1). Thus, drain conduit 290 can place sump 254 of water funnel 250 and evaporation pan 172 in fluid communication with each other and permit excess liquid water to drain from ice making assembly 160 to evaporation pan 172. In alternative exemplary embodiments, drain conduit 290 can extend between sump 254 of water funnel 250 and a drain, e.g., that leads to a sewer or septic waste water system. Thus, drain conduit 290 can direct excess liquid water out of ice making assembly 160, e.g., to the sewer or septic waste water system.

FIG. 7 provides a schematic view of certain components of sealed system 300. It will be understood that while described in the context of refrigerator appliance 100, sealed system 300 may be used in any suitable refrigerator. Components of sealed system 300 may be positioned within a machinery compartment 170, e.g., at bottom portion 102 of housing 120.

Sealed system 300 contains components for executing a vapor compression cycle for cooling fluid. The components include a compressor 310, a condenser 320, a first capillary tube 330, a chilled chamber or first evaporator 332, a second capillary tube 340, an icemaker or second evaporator 342, and a third capillary tube 344. Compressor 310 is operable to generate compressed refrigerant. First capillary tube 330 is connected to receive the compressed refrigerant from compressor 310. For example, first capillary tube 330 has an inlet 360 that is connected to an outlet 314 of compressor 310 to receive the compressed refrigerant from compressor 310. First evaporator 332 is positioned proximate freezer chamber 124 within housing 120. First evaporator 332 is connected in series with first capillary tube 330. Thus, within sealed system 300, refrigerant may flow through first capillary tube 330 to first evaporator 332. Second capillary tube 340 is also connected to receive the compressed refrigerant from compressor 310. For example, second capillary tube 340 has an inlet 370 that is connected to outlet 314 of compressor 310 to receive the compressed refrigerant from compressor 310. Second evaporator 342 is positioned proximate an inlet 182 of supply duct 180 (FIG. 1). Second and third capillary tubes 340, 344 are connected in series with second evaporator 342, e.g., such that second evaporator 342 is positioned between second and third capillary tubes 340, 344. Thus, within sealed system 300, refrigerant may flow through second capillary tube 340 to second evaporator 342, and refrigerant may flow through second evaporator 342 to third capillary tube 344. As shown in FIG. 7, first capillary tube 330 and first evaporator 332 may be connected in parallel with second and third capillary tubes 340, 344 and second evaporator 342 within sealed system 300, An outlet 372 of third capillary tube 344 and an outlet 362 of first evaporator 332 may be connected to an inlet 312 of compressor 310. Thus, refrigerant may flow through third capillary tube 344 to compressor 310 and from first evaporator 332 to compressor 310. Suitable conduits, such as copper tubing, may connect the components of sealed system 300 in the manner described above.

Sealed system 300 is charged with a refrigerant and is operable to cool air within refrigerator appliance 100. First evaporator 332 may be positioned at within freezer chamber 124 and cool air therein. Conversely, second evaporator 342 may be positioned separately from first evaporator 332 within housing 120, e.g., such that chilled air from second evaporator 342 does not mix with chilled air from first evaporator 332. In certain exemplary embodiments, second evaporator 342 may be positioned at or adjacent fresh food chamber 122 while first evaporator 332 is positioned in or at freezer chamber 124. Thus, sealed system 300 may be a parallel dual evaporator sealed system. However, it should be understood that the present subject matter is not limited to use with parallel dual evaporator sealed systems and may be implemented in a serial dual evaporator sealed systems or a hybrid dual evaporator sealed system.

Within sealed system 300, gaseous refrigerant flows into compressor 310, which operates to increase the pressure of the refrigerant. This compression of the refrigerant raises its temperature, which is lowered by passing the gaseous refrigerant through condenser 320. Within condenser 320, heat exchange with ambient air takes place so as to cool the refrigerant and cause the refrigerant to condense to a liquid state. A condenser fan (not shown) may be used to pull air across condenser 320 so as to provide forced convection for a more rapid and efficient heat exchange between the refrigerant within condenser 320 and the ambient air. Thus, as will be understood by those skilled in the art, increasing air flow across condenser 320 can, e.g., increase the efficiency of condenser 320 by improving cooling of the refrigerant contained therein. A dryer 322 may also be disposed downstream of condenser 320 and upstream of first and second capillary tubes 330, 340.

From first capillary tube 330, liquid refrigerant enters first evaporator 332. Upon exiting first capillary tube 330 and entering first evaporator 332, the liquid refrigerant drops in pressure and vaporizes. Due to the pressure drop and phase change of the refrigerant, first evaporator 332 is cool relative to freezer chamber 124 of refrigerator appliance 100. As such, cooled air is produced and configured to refrigerate freezer chamber 124 of refrigerator appliance 100. Thus, first evaporator 332 is a type of heat exchanger which transfers heat from air passing over first evaporator 332 to refrigerant flowing through first evaporator 332.

Similarly, liquid refrigerant enters second evaporator 342 from second capillary tube 340. Upon exiting second capillary tube 340 and entering second evaporator 342, the liquid refrigerant drops in pressure and vaporizes. Due to the pressure drop and phase change of the refrigerant, second evaporator 342 is cool. As such, cooled air is produced and configured to refrigerate ice making assembly 160. Thus, second evaporator 342 is a type of heat exchanger which transfers heat from air passing over second evaporator 342 to refrigerant flowing through second evaporator 342.

Sealed system 300 may also include a first fan 350 and a second fan 352. First fan 350 is positioned at or adjacent first evaporator 332, e.g., within freezer chamber 124. When activated, first fan 350 directs or urges air over first evaporator 332, e.g., and circulates such air within freezer chamber 124. Similarly, second fan 352 is positioned at or adjacent second evaporator 342, e.g., at inlet 182 of supply duct 180. When activated, second fan 352 directs or urges air over second evaporator 342, e.g., and circulates such air to ice making assembly 160 via supply duct 180. Second fan 352 may be positioned within supply duct 180 or at inlet 182 of supply duct 180.

Operation of sealed system 300 is controlled by a processing device or controller 380, e.g., that may be operatively coupled to a control panel (not shown) for user manipulation to select refrigeration features of sealed system 300. Controller 380 can operates various components of sealed system 300 to execute selected system cycles and features. For example, controller 380 is in operative communication with compressor 310 and first and second fans 350, 352. Thus, controller 380 can selectively activate and operate compressor 310 and first and second fans 350, 352.

First capillary tube 330 may be sized such that the chilled air generated at first evaporator 332 is a first temperature, e.g., that is suitable for freezer chamber 124, during operation of sealed system 330. Conversely, second capillary tube 340 may be sized such that the chilled air generated at second evaporator 342 is a second temperature, e.g., that is suitable for ice formation at ice making assembly 160, during operation of sealed system 300. The first and second temperatures may be different. For example, the first temperature may be less than the second temperature. In particular, the first temperature may be about negative nine degrees Fahrenheit (9° F.) and the second temperature may be about twenty degrees Fahrenheit (20° F.). As another example, the first temperature may be no less than negative six degrees Celsius (−6° C.) and no greater than zero degrees Celsius (0° C.), and the second temperature may be no less than negative twenty-seven degrees Celsius (−27° C.) and no greater than negative twenty degrees Celsius (−20° C.). Thus, first and second capillary tubes 330, 340 may be tuned to provide specific temperature air to freezer chamber 124 and to ice making assembly 160, respectively.

Third capillary tube 344 may be sized such that a temperature and pressure of refrigerant at outlet 362 of first evaporator 332 is about a temperature and pressure of refrigerant at outlet 372 of third capillary tube 344 during operation of sealed system 300. Thus, third capillary tube 344 may be sized such that third capillary tube 344 collectively with second capillary tube 340 and second evaporator 342 restrict and condition refrigerant in a similar manner to first capillary tube 330 and first evaporator 332. Thus, refrigerant immediately downstream of first evaporator 332 may be easily combined with refrigerant from third capillary tube 344 by suitably sizing third capillary tube 344.

First, second and third capillary tubes 330, 340, 344 may be sized in any suitable manner. For example, it will be understood that first capillary tube 330 may be suitably sized by adjusting or selecting at least one of a length of first capillary tube 330 and an inner diameter or width of first capillary tube 330. Second and third capillary tubes 340, 344 may also suitably sized by adjusting or selecting an associated length or inner diameter/width of the second and third capillary tubes 340, 344.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A refrigerator appliance, comprising:

a cabinet defining a chilled chamber for receipt of food items for storage, the cabinet having a door and defining a duct;

an icemaker comprising a mold body defining an ice cavity and a manifold positioned over the ice cavity of the mold body such that water from the manifold is flowable through the ice cavity, the ice maker further comprising a water funnel and a pump, the water funnel positioned below the mold body, the water funnel tapered towards a sump of the water funnel, the pump connected to the sump of the water funnel and the manifold such that the pump is operable to flow water from the sump of the water funnel to the manifold, the ice maker further comprising an ice-collector, the ice collector positioned below the mold body to receive ice from the ice cavity, the ice collector having a bottom wall sloped towards a collection volume of the ice-collector, an ice inlet of the ice-collector offset from a water inlet of the water funnel in a plane that is perpendicular to a vertical direction; and a sealed system positioned within the cabinet, the sealed system comprising a compressor operable to generate compressed refrigerant;

a first capillary tube connected to receive condensed refrigerant;

a first evaporator positioned proximate the chilled chamber of the cabinet, the first evaporator connected in series with the first capillary tube;

a second capillary tube connected to receive condensed refrigerant;

a third capillary tube; and a second evaporator positioned proximate an inlet of the duct, the second and third capillary tubes connected in series with the second evaporator such that the second evaporator is between the second and third capillary tubes, wherein one or both of a length and an inner diameter of the first capillary tube is selected such that the chilled air at the first evaporator is a first temperature during operation of the sealed system, and wherein one or both of a length and an inner diameter of the second capillary tube is selected such that the chilled air at the second evaporator is a second temperature during operation of the sealed system, the first temperature being less than the second temperature.

2. The refrigerator appliance of claim 1, wherein the icemaker is positioned on the door of the cabinet, chilled air from the second evaporator flowable through the duct towards the icemaker to cool the icemaker and chilled air from the first evaporator flowable to the chilled chamber of the cabinet.

3. The refrigerator appliance of claim 1, wherein the first temperature is no less than negative six degrees Celsius and no greater than zero degrees Celsius, the second temperature is no less than negative twenty-seven degrees Celsius and no greater than negative twenty degrees Celsius.

4. The refrigerator appliance of claim 1, wherein an outlet of the third capillary tube and an outlet of the first evaporator are connected to an inlet of the compressor.

5. The refrigerator appliance of claim 4, wherein one or both of a length and an inner diameter of the third capillary tube is selected such that a temperature and pressure of refrigerant at the outlet of the first evaporator is equal to a temperature and pressure of refrigerant at the outlet of the third capillary tube during operation of the sealed system.

6. The refrigerator appliance of claim 1, wherein the first capillary tube and the first evaporator are connected in parallel with the second and third capillary tubes and the second evaporator in the sealed system.

7. The refrigerator appliance of claim 1, wherein the sealed system further comprises a condenser positioned downstream of the compressor and upstream of the first and second capillary tubes.

8. A refrigerator appliance, comprising:

a cabinet defining a chilled chamber for receipt of food items for storage, the cabinet having a door and defining a duct;

an icemaker positioned on the door of the cabinet, the icemaker comprising a mold body defining an ice cavity and a manifold positioned over the ice cavity of the mold body such that water from the manifold is flowable through the ice cavity, the ice maker further comprising a water funnel and a pump, the water funnel positioned below the mold body, the water funnel tapered towards a sump of the water funnel, the pump connected to the sump of the water funnel and the manifold such that the pump is operable to flow water from the sump of the water funnel to the manifold, the ice maker further comprising an ice-collector, the ice collector positioned below the mold body to receive ice from the ice cavity, the ice collector having a bottom wall sloped towards a collection volume of the ice-collector, an ice inlet of the ice-collector offset from a water inlet of the water funnel in a plane that is perpendicular to a vertical direction; and a sealed system positioned within the cabinet, the sealed system comprising a compressor operable to generate compressed refrigerant;

a first capillary tube having an inlet that is connected to an outlet of the compressor to receive condensed refrigerant from the compressor;

a first evaporator positioned proximate the chilled chamber of the cabinet, the first evaporator connected in series with the first capillary tube;

a second capillary tube having an inlet that is connected to the outlet of the compressor to receive condensed refrigerant from the compressor;

a third capillary tube having an outlet that is connected to an inlet of the compressor; and a second evaporator positioned proximate an inlet of the duct, the second and third capillary tubes connected in series with the second evaporator such that the second evaporator is between the second and third capillary tubes, wherein one or both of a length and an inner diameter of the first capillary tube is selected such that chilled air at the first evaporator is a first temperature during operation of the sealed system, and wherein one or both of a length and an inner diameter of the second capillary tube is selected such that chilled air at the second evaporator is a second temperature during operation of the sealed system, the first temperature being less than the second temperature.

9. The refrigerator appliance of claim 8, wherein chilled air from the second evaporator is flowable through the duct towards the icemaker to cool the icemaker and chilled air from the first evaporator is flowable to the chilled chamber of the cabinet.

10. The refrigerator appliance of claim 8, wherein the first temperature is no less than negative six degrees Celsius and no greater than zero degrees Celsius and the second temperature is no less than negative twenty-seven degrees Celsius and no greater than negative twenty degrees Celsius.

11. The refrigerator appliance of claim 10, wherein one or both of a length and an inner diameter of the third capillary tube is selected such that a temperature and pressure of refrigerant at the outlet of the first evaporator is equal to a temperature and pressure of refrigerant at the outlet of the third capillary tube during operation of the sealed system.

12. The refrigerator appliance of claim 8, wherein the first capillary tube and the first evaporator are connected in parallel with the second and third capillary tubes and the second evaporator in the sealed system.

13. The refrigerator appliance of claim 8, wherein the sealed system further comprises a condenser, the inlet of the first capillary tube and the inlet of the second capillary tube connected to the outlet of the compressor through the condenser.

14. The refrigerator appliance of claim 8, wherein the ice maker further comprises a water funnel and a pump, the water funnel positioned below the mold body, the water funnel tapered towards a sump of the water funnel, the pump connected to the sump of the water funnel and the manifold such that the pump is operable to flow water from the sump of the water funnel to the manifold.

* * * * *